US008131001B2

(12) United States Patent
Toyofuku et al.

(10) Patent No.: US 8,131,001 B2
(45) Date of Patent: Mar. 6, 2012

(54) SPEAKER DIAPHRAGM AND ELECTRODYNAMIC LOUDSPEAKER USING THE SAME

(75) Inventors: Kenichiro Toyofuku, Neyagawa (JP); Hiroyasu Kumo, Neyagawa (JP); Taihei Okada, Neyagawa (JP)

(73) Assignee: Onkyo Corporation, Neyagawa (JP)

( * ) Notice: Subject to any disclaimer, the term of this patent is extended or adjusted under 35 U.S.C. 154(b) by 847 days.

(21) Appl. No.: 12/183,201

(22) Filed: Jul. 31, 2008

(65) Prior Publication Data

US 2009/0041291 A1 Feb. 12, 2009

(30) Foreign Application Priority Data

Aug. 7, 2007 (JP) ..... 2007-205978
Jan. 24, 2008 (JP) ..... 2008-013225

(51) Int. Cl.
*H04R 1/00* (2006.01)
*H04R 9/06* (2006.01)
*H04R 11/02* (2006.01)
*H04R 1/20* (2006.01)

(52) U.S. Cl. ..... 381/398; 381/346; 381/423

(58) Field of Classification Search ..... 381/398, 381/407, 408, 423–432
See application file for complete search history.

(56) References Cited

U.S. PATENT DOCUMENTS

| | | | | |
|---|---|---|---|---|
| 3,596,733 | A * | 8/1971 | Bertagni | 381/431 |
| 7,020,302 | B2 | 3/2006 | Konishi et al. | |
| 2002/0094095 | A1 * | 7/2002 | Ellis et al. | 381/152 |
| 2004/0146174 | A1 * | 7/2004 | Iwasa et al. | 381/396 |
| 2005/0226456 | A1 * | 10/2005 | Tabata et al. | 381/398 |

FOREIGN PATENT DOCUMENTS

| | | |
|---|---|---|
| JP | 175394 | 10/1949 |
| JP | 40-32164 | 11/1965 |
| JP | 50-61834 | 6/1975 |
| JP | 57-132500 | 8/1982 |
| JP | 58-092198 | 6/1983 |
| JP | 3-58100 | 6/1991 |
| JP | 2001-036987 | 2/2001 |
| JP | 2001-285991 | 10/2001 |
| JP | 2004-040294 | 2/2004 |
| JP | 2007-036990 | 2/2007 |
| JP | 2007-180910 | 7/2007 |

* cited by examiner

*Primary Examiner* — Charles Garber
*Assistant Examiner* — Calvin Choi
(74) *Attorney, Agent, or Firm* — Renner, Otto, Boisselle & Sklar, LLP

(57) ABSTRACT

The present invention provides a loudspeaker diaphragm and an electrodynamic loudspeaker of an elongated shape being shorter in the minor-axis direction than in the major-axis direction, which have a desirable sound reproducing capability with a high efficiency and are not significantly influenced by divided vibrations of an elongated loudspeaker diaphragm, and which are suitably installed in devices such as display devices. In the elongated loudspeaker diaphragm: the diaphragm body includes a first diaphragm portion in a central portion of a rear surface thereof, the first diaphragm portion including a junction to a voice coil bobbin, a second diaphragm portion extending on each side of the first diaphragm portion in the major-axis direction, and a reinforcement rib extending continuously through the first diaphragm portion and the second diaphragm portions; and the edge includes a free edge portion for freely supporting opposite ends in the minor-axis direction of the first diaphragm portion and the second diaphragm portion, and a fixed edge portion being thicker than the free edge portion for fixedly supporting a distal end of each second diaphragm portion in the major-axis direction.

10 Claims, 10 Drawing Sheets

(a)

(b)

(a)

(b)

(a)

(b)

(a) Sec. O-A'

(b) Sec. B-B'

(c) Sec. C-C'

(a)

(b)

SPEAKER DIAPHRAGM AND ELECTRODYNAMIC LOUDSPEAKER USING THE SAME

BACKGROUND OF THE INVENTION

1. Field of the Invention

The present invention relates to a loudspeaker diaphragm and an electrodynamic loudspeaker, and more particularly to those of an elongated shape being shorter in the minor-axis direction than in the major-axis direction (e.g., a rectangular shape and an elongated circular shape (including an elliptical shape and a racetrack shape)), which have a desirable sound reproducing capability and are not significantly influenced by divided vibrations of an elongated loudspeaker diaphragm, and which are suitably installed in devices such as display devices.

2. Description of the Related Art

With an acoustic device, such as a display device, in which a loudspeaker is installed for reproducing sound, there is a demand for reducing the amount of space required for installing the loudspeaker. Particularly, electrodynamic loudspeakers of an elongated shape (e.g., a rectangular shape and an elongated circular shape (including an elliptical shape and a racetrack shape)) have disadvantages in the sound reproducing capability for various reasons, such as: the diaphragm area is limited in the minor-axis direction; there is a significant influence of divided vibrations that are characteristic of a loudspeaker diaphragm of an elongated shape, whereby it is difficult to obtain a flat frequency response; and when a foam resin material, or the like, is employed in order to achieve both a high rigidity and a light weight of the loudspeaker diaphragm, it will not be possible to set the highest reproducible frequency to be high. Therefore, various loudspeaker diaphragms, loudspeaker magnetic circuits and electrodynamic loudspeakers using the same have been proposed in the art in order to solve these problems in the prior art.

For example, Japanese Laid-Open Patent Publication No. 58-92198 discloses an electrodynamic loudspeaker, including a voice coil bobbin that is in contact simultaneously with two nodes in different ones of free vibration modes of a rectangular planar diaphragm, with a voice coil provided around the bobbin reciprocating in a gap of a magnetic circuit for driving the rectangular planar diaphragm in a node-driving method, wherein a peripheral portion of the rectangular planar diaphragm is connected to a frame via an asymmetric edge member having a greater width on a short side farther away from a driving section for driving the voice coil than on another short side closer to the driving section for driving the voice coil.

Japanese Utility Model Publication for Opposition No. 40-32164 discloses a loudspeaker having a rectangular planar diaphragm of a foam resin, wherein sides along the major axis of the planar diaphragm are fixed to a frame with other sides along the minor axis thereof being free edges, thereby stabilizing the operation. Japanese Laid-Open Patent Publication No. 2001-285991 discloses a loudspeaker in which a generally arc-shaped elastic resin member is laid on the edge at each corner formed by the frame and subjected to a heating process, providing an elastic resin layer in the vicinity of each corner portion of the edge, which often deforms when driving the loudspeaker, thereby absorbing and reducing the distortion due to bending, deformation, etc., of the edge, and thus preventing the consequent deterioration of the sound quality.

Japanese Laid-Open Utility Model Publication No. 50-61834 discloses a loudspeaker diaphragm obtained by laminating together a thermoplastic film foam, and a body that is light-weighted and rigid, with no vibrating substrate being used in the edge portion. Japanese Laid-Open Patent Publication No. 57-132500 discloses a loudspeaker diaphragm formed by laminating a thermoplastic resin film on one side or on both sides of an unexpanded thermofoaming resin sheet and subjecting the laminate to a heat process in a mold of a diaphragm shape to plasticize the thermoplastic resin film and to expand the thermofoaming resin sheet, thus forming the laminate into the diaphragm shape, with a peripheral extension of the thermoplastic resin film being formed as the edge.

Japanese Laid-Open Patent Publication No. 2007-180910, filed by the applicant hereof, discloses a loudspeaker diaphragm, including an edge junction portion provided along an outer periphery of the diaphragm and joined with an edge, and a diaphragm portion provided on an inner periphery side of the edge junction portion and joined with a voice coil, wherein the diaphragm portion has a virtual reference plane defined as a plane containing the edge junction portion, and the diaphragm portion has a wavy shape including a plurality of node lines each defined as a line along which the diaphragm portion intersects with the virtual reference plane and a plurality of ridge lines each defined as a line that connects together points where the distance from the virtual reference plane takes a local maximum, and wherein the plurality of node lines are not parallel to, and do not cross, a major axis of the diaphragm, with one or more of the node lines crossing a minor axis of the diaphragm. Forming a loudspeaker diaphragm in such a wavy shape improves the strength of the elongated diaphragm in the longitudinal direction, i.e., the major-axis direction, whereby it is possible to shift the resonance frequency at which divided resonance occurs in the major-axis direction to a higher frequency. Moreover, the intervals between ridges/troughs of the wavy shape in the minor-axis direction gradually change in the major-axis direction, whereby it is possible to break up the resonance frequency of the divided resonance, which is likely to occur in the major-axis direction. As a result, by using an elongated diaphragm having such a wavy shape, it is possible to realize a loudspeaker having a desirable sound reproduction quality with few peaks and dips in the frequency response.

In order to realize a desirable sound reproduction with an acoustic device such as a display device, it is preferred that an electrodynamic loudspeaker having a sound reproduction quality as good as that of Japanese Laid-Open Patent Publication No. 2007-180910 is installed in the acoustic device. However, when one employs a loudspeaker diaphragm that is formed by using a foam resin to reduce the weight thereof for the purpose of improving the reproduced sound pressure level, the influence of divided vibrations in the major-axis direction becomes pronounced, thereby causing various problems. For example, it may become difficult to realize a flat frequency response, and it may not be possible to increase the highest reproducible frequency. Where the loudspeaker diaphragm is supported with its end portion being fixed, the symmetry between the forward and backward amplitudes may become poor, thus deteriorating the distortion characteristics. In the context of the expression "forward and backward amplitudes" of the speaker diaphragm vibration as used herein, the side on which the voice coil, the damper and the magnetic circuit are attached is the rear side or the backward direction, and the side on which the diaphragm is exposed is the front side or the forward direction.

SUMMARY OF THE INVENTION

A loudspeaker diaphragm of the present invention is a loudspeaker diaphragm, including a diaphragm body of an elongated shape defining a major-axis direction and a minor-axis direction, and an edge for supporting an outer periphery of the diaphragm body, wherein: the diaphragm body includes a first diaphragm portion in a central portion of a rear surface thereof, the first diaphragm portion including a junction to a voice coil bobbin, a second diaphragm portion extending on each side of the first diaphragm portion in the major-axis direction, and a reinforcement rib extending continuously through the first diaphragm portion and the second diaphragm portions; and the edge includes a free edge portion for freely supporting opposite ends in the minor-axis direction of the first diaphragm portion and the second diaphragm portion, and a fixed edge portion being thicker than the free edge portion for fixedly supporting a distal end of each second diaphragm portion in the major-axis direction.

One embodiment of the present invention is directed to a loudspeaker diaphragm as set forth above, wherein the first diaphragm portion of the diaphragm body has an area larger than a projected area of the voice coil bobbin, and an average thickness of the first diaphragm portion is smaller than that of the second diaphragm portion.

One embodiment of the present invention is directed to a loudspeaker diaphragm as set forth above, wherein: the reinforcement rib includes major-axis side ribs formed at opposite ends of the diaphragm body in the minor-axis direction, a major-axis central rib formed in a central portion of the diaphragm body in the minor-axis direction, and a minor-axis side rib formed at a distal end of each second diaphragm portion in the major-axis direction; and the minor-axis side ribs connect together the major-axis side ribs and are not connected to the major-axis central rib.

One embodiment of the present invention is directed to a loudspeaker diaphragm as set forth above, wherein: the major-axis central rib of the reinforcement rib is divided into two separate ribs, including a first major-axis central rib and a second major-axis central rib, which are arranged with the junction to the voice coil bobbin being interposed therebetween; and a height of the first major-axis central rib and the second major-axis central rib is largest in the first diaphragm portion and gradually decreases through the second diaphragm portion toward either end in the major-axis direction.

One embodiment of the present invention is directed to a loudspeaker diaphragm as set forth above, wherein the diaphragm body includes an extruded thermoplastic resin foam sheet whose surface is laminated with a thermoplastic resin film, and wherein the diaphragm body and the edge, which is obtained by integrally forming the free edge portion and the fixed edge portion, are bonded together by an adhesive.

One embodiment of the present invention is directed to a loudspeaker diaphragm as set forth above, wherein the diaphragm body includes an extruded thermoplastic resin foam sheet whose front and rear surfaces are laminated with a thermoplastic resin film, and the edge includes the thermoplastic resin film extended from the front and rear surfaces of the diaphragm body, and wherein the diaphragm body and the edge are integrally formed with a reinforcement, the reinforcement being a thermoplastic resin foam sheet whose front and rear surfaces are laminated with the thermoplastic resin film for supporting an outer periphery of the edge.

One embodiment of the present invention is directed to a loudspeaker diaphragm as set forth above, wherein: the free edge portion of the edge includes a first free edge portion for freely supporting opposite ends of the first diaphragm portion in the minor-axis direction, and a second free edge portion for freely supporting opposite ends of the second diaphragm portion in the minor-axis direction; and a stiffness k1 of the first free edge portion is smaller than a stiffness k2 of the second free edge portion.

An electrodynamic loudspeaker of the present invention is an electrodynamic loudspeaker, including a loudspeaker diaphragm of the present invention, a frame to which an outer periphery of the edge is fixed, a magnetic circuit fixed to the frame and having a magnetic gap, a voice coil wound around the voice coil bobbin, and a damper for disposing the voice coil in the magnetic gap.

Effects of the present invention will now be described.

A loudspeaker diaphragm of the present invention is a loudspeaker diaphragm, including a diaphragm body of an elongated shape defining a major-axis direction and a minor-axis direction (e.g., a rectangular shape and an elongated circular shape (including an elliptical shape and a racetrack shape)), and an edge for supporting an outer periphery of the diaphragm body. The diaphragm body is obtained by laminating the surface of a thermoplastic resin foam sheet (typically, a polystyrene foam sheet), which is formed to have a non-uniform thickness by using a plug-assist vacuum molding, with a thermoplastic resin film. The thermoplastic resin film (or sheet) with which the diaphragm body is laminated is typically a polystyrene resin film or a polyurethane elastomer resin film. Thus, the loudspeaker diaphragm of the present invention can be made into an intended elongated shape, as follows. A laminated thermoplastic resin foam sheet is softened by pre-heating, mold-pressed and cooled, thereby forming a diaphragm body in an elongated shape, after which an edge of a foam rubber, or the like, is bonded to the periphery of the diaphragm body. Alternatively, the edge is integrally formed with the diaphragm body using a laminated thermoplastic resin film. With the loudspeaker diaphragm of the present invention, it is possible to provide an electrodynamic loudspeaker of an elongated shape by additionally providing a frame, a magnetic circuit, a voice coil wound around a voice coil bobbin, and a damper. The major-axis direction as used herein refers to the direction in which the major axis of an elongated shape, such as a rectangular shape, an elongated circular shape, an elliptical shape or a racetrack shape, extends, whereas the minor-axis direction as used herein refers to the direction in which the minor axis thereof extends perpendicular to the major axis.

The diaphragm body of the loudspeaker diaphragm of the present invention includes a first diaphragm portion in a central portion of a rear surface thereof, the first diaphragm portion including a junction to a voice coil bobbin, a second diaphragm portion extending on each side of the first diaphragm portion in the major-axis direction, and a reinforcement rib extending continuously through the first diaphragm portion and the second diaphragm portions. The diaphragm body is formed in an elongated shape, such as a rectangular shape, an elongated circular shape, an elliptical shape or a racetrack shape, and includes the reinforcement rib connecting the first diaphragm portion with the second diaphragm portions extending from the opposite ends of the first diaphragm portion. Therefore, the reinforcement rib suppresses divided vibrations in the major-axis direction, whereby it is possible to realize a flat frequency response with few peaks and dips.

The first diaphragm portion is an area in the central portion of the rear surface of the loudspeaker diaphragm to which the cylindrical voice coil bobbin is attached, and is a generally rectangular area defined by two long sides of the elongated loudspeaker diaphragm and two virtual lines extending in the minor-axis direction across the long sides. The area of the first diaphragm portion is larger than the projected area of the voice coil bobbin. The second diaphragm portions are areas extending from the virtual lines of the first diaphragm portion toward the opposite ends in the major-axis direction away from the voice coil bobbin (i.e., outwardly in the major-axis direction). The reinforcement ribs are each a protrusion that forms either a ridge or a trough as seen from the front side of the loudspeaker diaphragm. The reinforcement ribs may include major-axis side ribs, opposing each other in the minor-axis direction, and a major-axis central rib, and may also include a minor-axis side rib formed at a distal end of each second diaphragm portion in the major-axis direction.

For example, the major-axis central rib of the reinforcement rib may be a rib that extends continuously through one of the second diaphragm portions, the first diaphragm portion and the other second diaphragm portion. Alternatively, the major-axis central rib may be divided into two separate ribs, including a first major-axis central rib and a second major-axis central rib, which are arranged with the junction to the voice coil bobbin being interposed therebetween, with the height of the ribs being largest in the first diaphragm portion and gradually decreasing through the second diaphragm portion toward either end in the major-axis direction. The reinforcement rib, including the major-axis central rib, enables the reproduction of the middle and high ranges in the first diaphragm portion as will be described below, and also ensures the symmetry between the forward and backward amplitudes, while increasing the rigidity of the elongated loudspeaker diaphragm in the major-axis direction.

The edge with a non-uniform thickness includes a free edge portion for freely supporting the opposite ends of the first diaphragm portion and the second diaphragm portions in the minor-axis direction, and a fixed edge portion being thicker than the free edge portion for fixedly supporting the distal end of each second diaphragm portion in the major-axis direction. The opposite ends of the diaphragm body of the present invention in the minor-axis direction (i.e., portions corresponding to the long sides of the diaphragm body) are freely supported by the free edge portion of the edge, and the opposite ends thereof in the major-axis direction (i.e., portions corresponding to the short sides of the diaphragm body) are fixedly supported by the fixed edge portion of the edge. Therefore, where the elongated loudspeaker diaphragm has the major axis significantly longer than the short axis and where the voice coil substantially displaces at a frequency near or below the lowest resonance frequency f0, the loudspeaker diaphragm vibrates in a lowest-order bending vibration mode where the opposite ends in the major-axis direction are fixedly supported to become the nodes while the central portion in the major-axis direction becomes the antinode, whereby it is possible to realize a flat frequency response while suppressing dips which are likely to first appear in the low range. Moreover, due to the rigidity of the reinforcement rib, it is possible to improve the symmetry between the forward and backward amplitudes of the loudspeaker diaphragm, thereby realizing an electrodynamic loudspeaker having a desirable sound reproduction quality with little distortion.

Moreover, the first diaphragm portion of the diaphragm body has an area larger than the projected area of the voice coil bobbin, and the average thickness of the first diaphragm portion is smaller than that of the second diaphragm portion. Thus, since the average thickness of the first diaphragm portion, with the voice coil bobbin being attached to the rear surface thereof, is made relatively small, the equivalent mass of a portion around the voice coil bobbin, which contributes to the radiation of sound waves in the middle and high ranges, is reduced, and the driving force generated by the voice coil is more efficiently transmitted. As a result, it is possible to increase the sound pressure level in the middle and high ranges. The free edge portion of the edge includes the first free edge portion for freely supporting the opposite ends of the first diaphragm portion in the minor-axis direction, and the second free edge portion for freely supporting the opposite ends of the second diaphragm portion in the minor-axis direction, and if the stiffness k1 of the first free edge portion is made smaller than the stiffness k2 of the second free edge portion by appropriately selecting the material or the shape, the possible range of amplitude of the first diaphragm portion is increased, whereby it is possible to further increase the sound pressure level and to improve the efficiency.

The material of the diaphragm body is not limited to an extruded polystyrene foam sheet, as long as it is a thermoplastic resin, including a polystyrene foam, and may be a foam of a resin selected from a polystyrene, an acrylic, a polyethylene, a polypropylene, a polycarbonate, an ABS resin, and the like, or a blend of two or more resins selected therefrom. There is no particular limitations on the edge bonded to the diaphragm body as long as it is an elastomer material with a non-uniform thickness, from which it is possible to form the free edge portion and the fixed edge portion. Other than the foam rubber or the thermoplastic resin film as mentioned above, the edge may be a urethane foam sheet molded with heat, or may be a rubber edge having a varied thickness formed by an injection molding, or the like. Where the edge of the loudspeaker diaphragm includes a thermoplastic resin film with which the front and rear surfaces of the diaphragm body are laminated and which is extended around the diaphragm body, the diaphragm body, the edge and the reinforcement, which reinforces the outer periphery of the edge, are integrally formed together. Therefore, it is possible to reduce the number of steps and the length of the process for producing a diaphragm product including the diaphragm body, the edge and the reinforcement, whereby it is possible to reduce the cost of an electrodynamic loudspeaker.

Thus, it is possible to provide an electrodynamic loudspeaker using a loudspeaker diaphragm of an elongated shape being shorter in the minor-axis direction than in the major-axis direction, which have a desirable sound reproducing capability with a high efficiency, which are not significantly influenced by divided vibrations, which have little distortion with a desirable symmetry between the forward and backward amplitudes, and which are suitably installed in devices such as display devices.

DETAILED DESCRIPTION OF THE PREFERRED EMBODIMENTS

Preferred embodiments of the present invention will now be described in detail with reference to the drawings. Note that the present invention is not limited to these particular embodiments set forth below.

Embodiment 1

Figure 1:
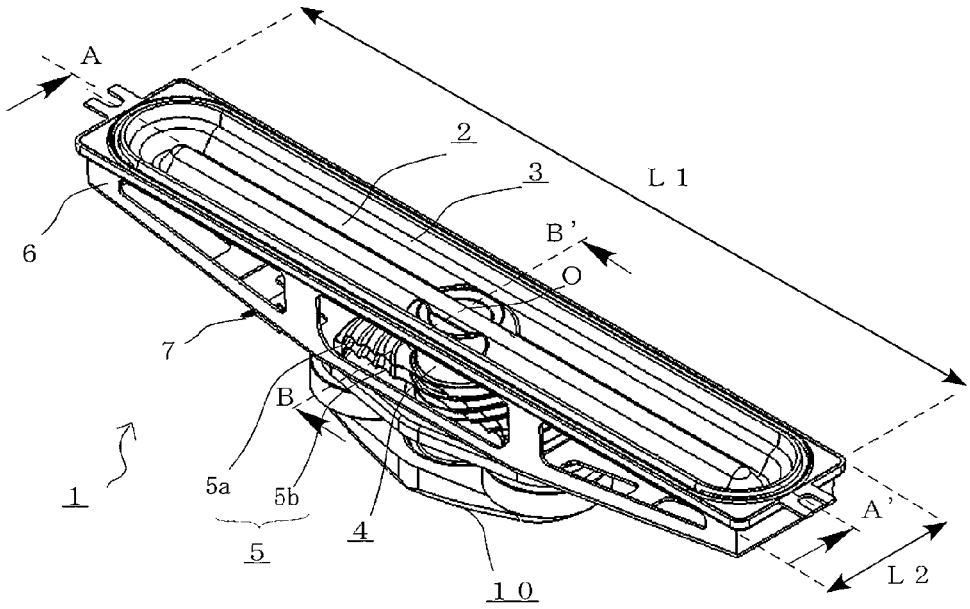
FIGS. 1A and 1B illustrate an electrodynamic loudspeaker 1.
Figure 1:
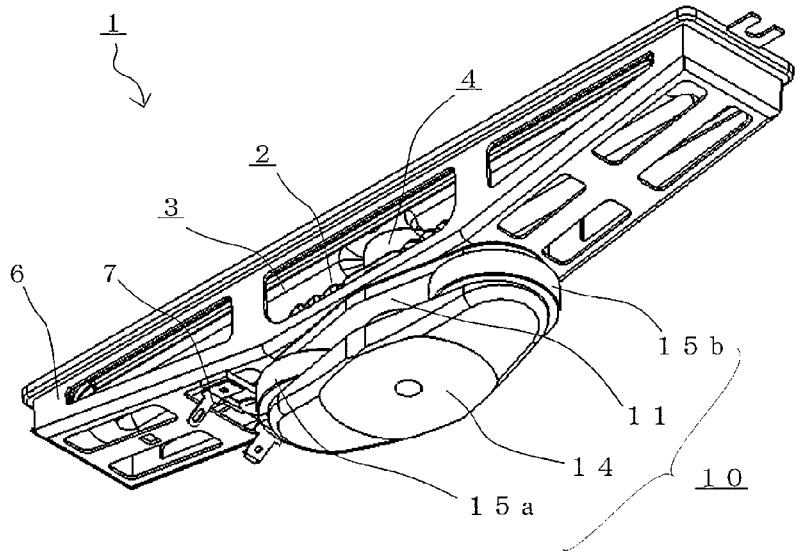
Figure 2:
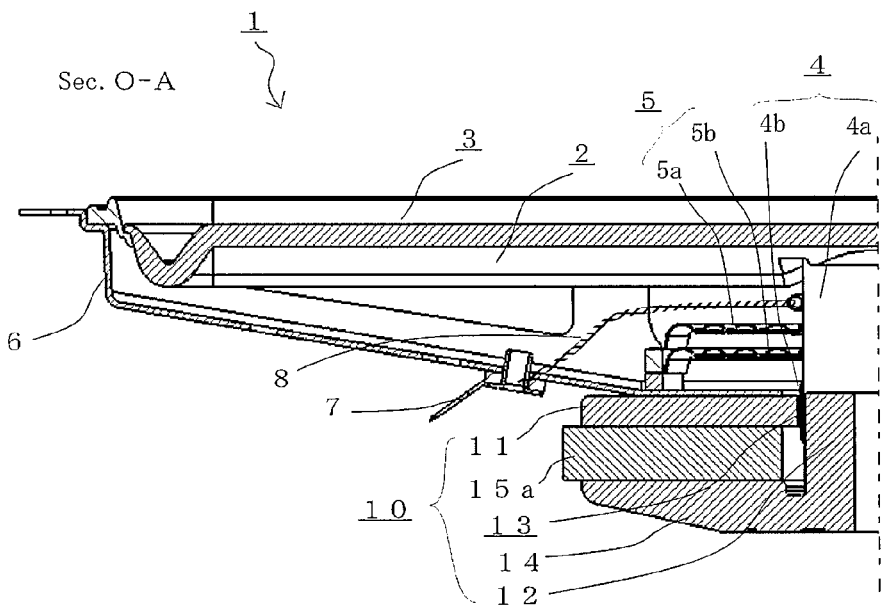
FIGS. 2A and 2B illustrate the electrodynamic loudspeaker 1.
Figure 2:
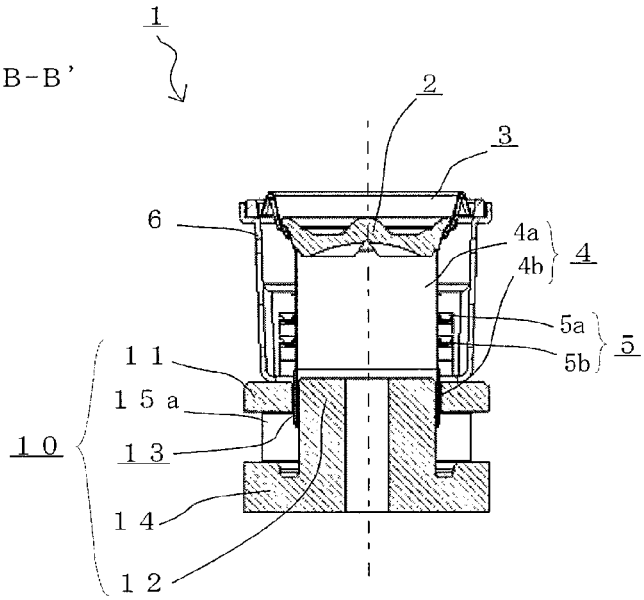

FIGS. 1A to 2B illustrate an electrodynamic loudspeaker 1 in a preferred embodiment of the present invention. FIG. 1A is a perspective view of the electrodynamic loudspeaker 1 as viewed in an inclined direction from the front side, and FIG. 1B is a perspective view thereof as viewed in an inclined direction from the rear side. FIG. 2A is a cross-sectional view of the electrodynamic loudspeaker 1 taken along line O-A, and FIG. 2B is a cross-sectional view thereof taken along line B-B'. As will be explained later, some elements of the electrodynamic loudspeaker 1, the inner structure thereof, etc., may not be shown in the figures. The direction of line A-A' is the major-axis direction, and the direction of line B-B' is the minor-axis direction.

The electrodynamic loudspeaker 1 of the present embodiment has an elongated shape and includes a racetrack-shaped loudspeaker diaphragm 2 whose length L1 in the major-axis direction is about 210 mm and whose length L2 in the minor-axis direction is about 35 mm. Despite the elongated shape, the electrodynamic loudspeaker 1 has as large a diaphragm area as a circular diaphragm whose diameter is about 90 mm. The outer periphery of the loudspeaker diaphragm 2 is supported by an edge 3, with the outer periphery of the edge 3 being fixed to a frame 6. A voice coil 4 is coupled to the rear surface of the loudspeaker diaphragm 2 and is supported by a damper 5 (including a front damper 5*a* and a rear damper 5*b*) so as to allow vibration of the voice coil 4. The frame 6 has an elongated shape in conformity with the loudspeaker diaphragm 2 having a racetrack shape, and a magnetic circuit 10 fixed to the frame 6 also has an elongated shape with a narrow width less than the length L2 in the minor-axis direction. Thus, the electrodynamic loudspeaker 1 is suitable for installation in a narrow space, such as side portions beside the display section of a display device, or the like.

The inner periphery portion of the edge 3 is bonded to the outer periphery of the loudspeaker diaphragm 2 of the electrodynamic loudspeaker 1, and the bobbin 4*a* of the voice coil 4 is bonded to the central portion of the rear surface of the loudspeaker diaphragm 2. A foamed thermoplastic resin is used as the loudspeaker diaphragm 2 in order to realize a light weight of the loudspeaker diaphragm. In the present embodiment, an extruded thermoplastic resin foam sheet (specifically, a polystyrene paper) is subjected to a plug-assist vacuum molding to obtain the ribbed loudspeaker diaphragm 2 whose thickness is not uniform. Specifically, since a loudspeaker diaphragm of an elongated shape in which the length L1 in the major-axis direction and the length L2 in the minor-axis direction are significantly different from each other will be significantly influenced by divided vibrations in the major-axis direction, the loudspeaker diaphragm 2 is provided with ribs extending in the major-axis direction so that the cross-sectional shape thereof in the minor-axis direction is generally a W-letter shape, thus giving a high rigidity in the major-axis direction. A thermoplastic resin film (specifically, a polystyrene film) is thermally bonded to the front and rear surfaces of the loudspeaker diaphragm 2, thereby increasing the rigidity of the loudspeaker diaphragm 2.

In the present embodiment, the edge 3 is obtained by pouring a flexible foam rubber material into a mold and then heating the material to allow foaming. A thin, corrugated (or rolled) free edge is formed so as to freely support the loudspeaker diaphragm 2 along each long side of the racetrack shape being a straight line extending in the major-axis direction of the loudspeaker diaphragm 2, whereas a thick fixed edge, which is not allowed to vibrate freely, is formed so as to fixedly support the loudspeaker diaphragm 2 along the short side of the racetrack shape being an arc extending in the minor-axis direction. As a result, the elongated loudspeaker diaphragm 2 in the minor-axis direction is supported flexibly by the compliance of the free edge portion of the edge 3, and in the major-axis direction, it is allowed to vibrate in bending vibration by the flexibility by the polystyrene paper of the loudspeaker diaphragm 2.

The voice coil 4 includes the cylindrical bobbin 4*a*, and a coil 4*b* wound around the bobbin 4*a* at one end thereof for carrying an audio signal current. The other end of the bobbin 4*a*, where the coil 4*b* is not wound around the bobbin 4*a*, is coupled to the central portion of the rear surface of the loudspeaker diaphragm 2 by an adhesive. The coil 4*b* is placed in an annular magnetic gap 13 of the magnetic circuit 10 to be described later. A lead wire 8 is soldered to a terminal 7, which is fixed to the frame 6, and to the coil 4*b* for the electric connection therebetween, thereby supplying an audio signal current to the coil 4*b*. Alternatively, a metal eyelet may be provided in the loudspeaker diaphragm 2, via which the lead wire 8 can be routed to the terminal 7.

The damper 5 is a double damper including the front damper 5*a* and the rear damper 5*b*, each obtained by cutting a circular corrugation damper into an elongated shape (a racetrack shape), the circular corrugation damper being obtained by impregnating a base material (i.e., a woven fabric of a flexible fiber material) with a phenol resin and molding the material. The inner periphery of each of the front damper 5*a* and the rear damper 5*b* is coupled to the cylindrical outer surface of the bobbin 4*a* to support the central portion of the rear surface of the loudspeaker diaphragm 2. The outer periphery of each of the front damper 5*a* and the rear damper 5*b* is fixed to a fixing portion of the frame 6. The damper 5 may be a corrugation damper of any other suitable shape, does not have to be a double damper, or may be made of any other suitable material. The damper 5 may be a butterfly damper of a metal or a resin including an arm for coupling together an inner periphery-side ring and an outer periphery-side ring.

The frame 6 is a steel frame pressed into an elongated basket-like shape in conformity with the shape of the loudspeaker diaphragm 2. The frame 6 includes a generally rectangular fixing portion to which the edge 3 is fixed, another fixing portion to which the dampers 5*a* and 5*b* and the magnetic circuit 10 are fixed, junctions for joining together these fixing portions, windows defined between the junctions, and an attachment hole for receiving the terminal 7. Thus, the loudspeaker vibrating system including the loudspeaker diaphragm 2, the edge 3, the voice coil 4 and the damper 5 is supported so that the loudspeaker vibrating system can vibrate with respect to the frame 6.

The magnetic circuit 10 includes an elongated top plate 11 fixed to the frame 6, a cylindrical center pole 12 inserted through a circular hole formed in the central portion of the top plate 11, an elongated under plate 14, and two main magnets 15*a* and 15*b* magnetized in the same direction. The top plate 11 and the center pole 12 form the annular magnetic gap 13 therebetween having a uniform width in the radial direction. The main magnets 15*a* and 15*b* are sandwiched between the top plate 11 and the under plate 14, and are arranged in symmetry in the major-axis direction with respect to the center pole 12.

The two main magnets 15*a* and 15*b* are each an Nd—Fe—B-based rare earth magnet, which exhibits a strong coercive force even with a small volume, and each have a generally cylindrical shape. The rare earth magnet as used herein is an Nd—Fe—B-based neodymium magnet or an Sm—Co-based samarium-cobalt magnet, being a magnet whose maximum energy product (BH)max takes a large value and which exhibits a high residual magnetization and a large coercive force. A rare earth magnet has a large coercive force, and is therefore capable of generating a high magnetic flux density. Moreover, a rare earth magnet has a high permeance coefficient, and is therefore not easily demagnetized.

In the present embodiment, the two main magnets 15*a* and 15*b* are provided in the major-axis direction of the magnetic circuit 10, with no magnets being provided in the minor-axis direction that generate a magnetic force. As a result, the overall shape of the magnetic circuit 10 is an elongated shape, and the angle of the opening is so wide that when the magnetic circuit 10 is viewed from sideways in the minor-axis direction, the cylindrical side surface of the center pole 12 is seen directly through the open space where no magnets are provided.

The magnetic circuit 10 is of an outer-magnet type, in which magnets are arranged outside of the coil 4*b* of the voice coil 4 as viewed from above. With the main magnets 15*a* and 15*b* of a strong magnetomotive force being arranged in the major-axis direction, the magnetic circuit of this type is suitable for an elongated loudspeaker such as the electrodynamic loudspeaker 1 of the present invention. If the maximum width of the magnetic circuit 10 can be reduced, the magnetic circuit 10 can be accommodated within the area of the elongated loudspeaker diaphragm 2 as viewed from above. Also with the employment of the light-weighted loudspeaker diaphragm 2, it is thus possible to realize the electrodynamic loudspeaker 1 having a high efficiency.

When an audio signal current is supplied to the coil 4*b* of the voice coil 4, a driving force acts upon the voice coil 4 in the magnetic gap 13, whereby the voice coil 4 vibrates in the up-down direction as shown in FIGS. 2A and 2B, and the loudspeaker diaphragm 2 coupled thereto also vibrates in the up-down direction. The loudspeaker diaphragm 2 in the minor-axis direction is supported flexibly by the free edge portion of the edge 3, which supports the outer periphery thereof. In the major-axis direction, the loudspeaker diaphragm 2 is allowed to vibrate in bending vibration by the flexibility of the polystyrene paper of the loudspeaker diaphragm 2. When the voice coil 4 is displaced substantially at a frequency near or below the lowest resonance frequency f0, the loudspeaker diaphragm 2, whose opposite ends in the major-axis direction are fixed, bends in a bow-like shape in the major-axis direction.

Even if the annular magnetic gap 13 has a uniform width in the radial direction, the magnetic flux density distribution of the magnetic circuit 10 in the major-axis direction is different from that in the minor-axis direction. Specifically, the magnetic flux density is very high in the major-axis direction where the main magnets 15*a* and 15*b* having a generally cylindrical shape and the annular magnetic gap 13 are closest to each other, thus making the magnetic flux density in the major-axis direction higher than that in the minor-axis direction. Since the magnetic flux density distribution in the circumferential direction in the annular magnetic gap 13 differs between the major-axis direction and the minor-axis direction, the driving force for driving the loudspeaker diaphragm 2 can also be made different between the major-axis direction and the minor-axis direction, thus reducing the peaks and dips in the frequency response.

Figure 3:
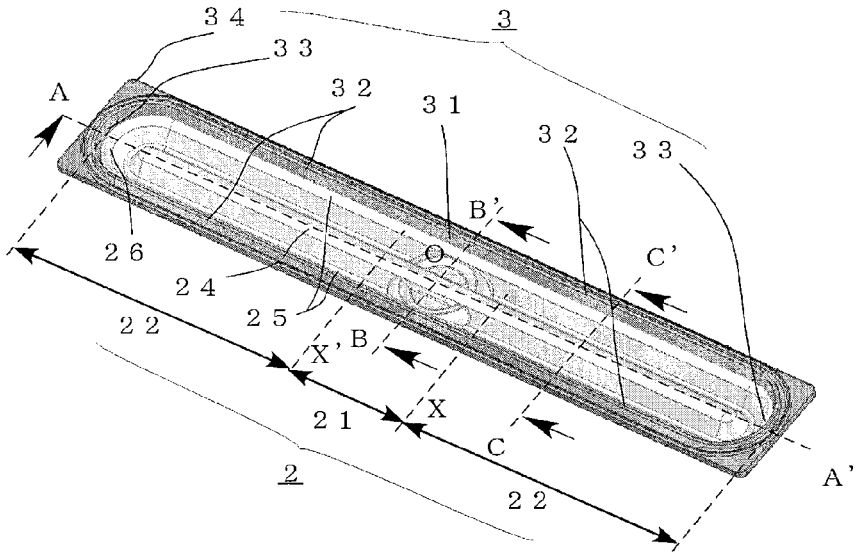
FIGS. 3A and 3B illustrate a loudspeaker diaphragm 2 and an edge 3.
Figure 3:
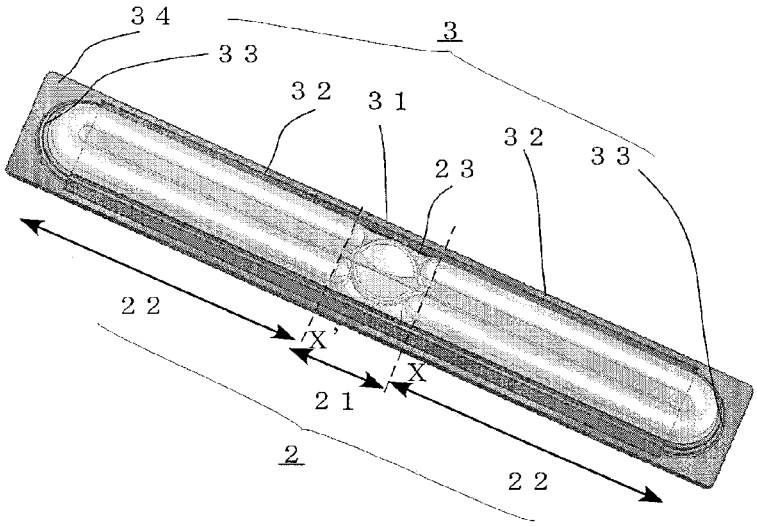
Figure 4:
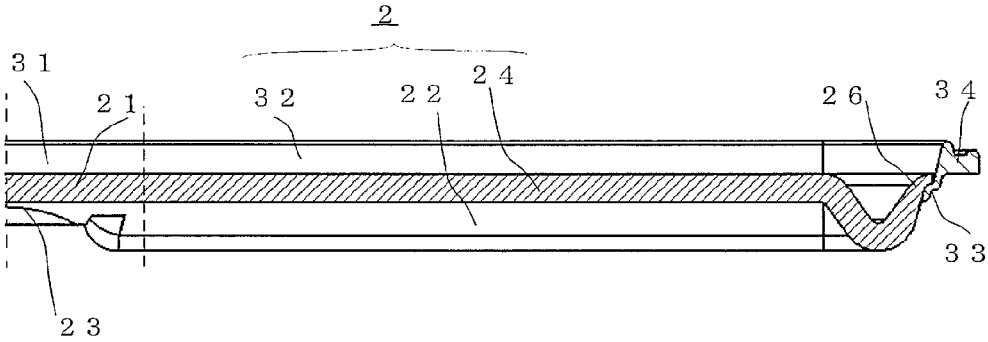
FIGS. 4A to 4C illustrate the loudspeaker diaphragm 2 and the edge 3.
Figure 4:
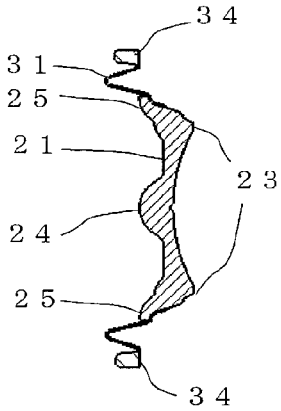
Figure 4:
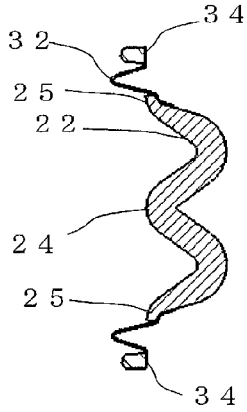

FIGS. 3A to 4C illustrate the loudspeaker diaphragm 2 and the edge 3. FIG. 3A is a perspective view of the loudspeaker diaphragm 2 and the edge 3 as viewed in an inclined direction from the front side, and FIG. 3B is a perspective view thereof as viewed in an inclined direction from the rear side. FIG. 4A is a cross-sectional view of the loudspeaker diaphragm 2 and the edge 3 taken along line O-A', FIG. 4B is a cross-sectional view thereof taken along line B-B', and FIG. 4C is a cross-sectional view thereof taken along line C-C'. As will be explained later, some elements of the loudspeaker diaphragm 2 and the edge 3, the cross section thereof, etc., may not be shown in the figures. The direction of line A-A' is the major-axis direction, and the direction of line B-B' is the minor-axis direction.

The loudspeaker diaphragm 2 of the present embodiment is formed to have a non-uniform thickness with ribs by subjecting an extruded polystyrene paper (PSP) to a plug-assist vacuum molding. A polyurethane elastomer film is thermally bonded to the front and rear surfaces of the loudspeaker diaphragm 2, thereby increasing the rigidity thereof. Specifically, the loudspeaker diaphragm 2 is formed by a plug-assist vacuum molding using a 10-times-expansion extruded polystyrene foam sheet (thickness: about 2.0 mm) mixed with 10% of an acrylic, with a polystyrene film (thickness: about 50 μm) being thermally bonded and laminated onto both surfaces. As compared with a case where the loudspeaker diaphragm is formed by using only an extruded polystyrene foam sheet, it is possible to improve the rigidity and the loss of the loudspeaker diaphragm by laminating a polystyrene film on one side or both sides thereof. For example, a loudspeaker diaphragm formed by using only PSP has a Young's modulus of 4.6E+8 (dyne/cm$^2$), a density of 0.43 (g/cm$^3$) and a tan δ of 0.043, whereas a loudspeaker diaphragm formed by laminating a polystyrene film on both sides of PSP as in the present embodiment has improved physical properties, i.e., a Young's modulus of 9.7E+8 (dyne/cm$^2$), a density of 0.55 (g/cm$^3$) and a tan δ of 0.074.

The racetrack-shaped loudspeaker diaphragm 2 has a length L1 in the major-axis direction of about 198 mm and a length L2 in the minor-axis direction of about 23.4 mm. The thickness of the loudspeaker diaphragm 2, formed by a vacuum molding, varies in the range from about 1 mm to about 3 mm. Thus, the thickness can be made non-uniform according to the level of rigidity required as a loudspeaker diaphragm. The loudspeaker diaphragm 2 has ribs extending in the major-axis direction, and the cross-sectional shape thereof in the minor-axis direction is a generally W-letter shape. For example, major-axis side ribs defining the outermost periphery of the loudspeaker diaphragm 2 has a thickness of about 1 mm.

A plug-assist vacuum molding is a process in which a laminated material is softened by pre-heating, and then sucked onto a female mold of an intended shape while being pressed by a male mold. The polystyrene paper of the present embodiment may be a foam sheet of any other thermoplastic resin, and the thermoplastic foam sheet can be obtained by an extrusion foaming method, a bead foaming method, or the like. The thermoplastic resin of the foam sheet may be a resin selected from a polystyrene, an acrylic, a polyethylene, a polypropylene, a polycarbonate, an ABS resin, a vinyl chloride resin, a vinyl acetate resin, a vinyl acetate-ethylene resin, and the like, or a blend of two or more resins selected therefrom.

The resin of the thermoplastic resin film to be laminated may be a resin selected from a polystyrene, an acrylic, a polyethylene, a polypropylene, a polyurethane, a polyethylene terephthalate, a polyethylene naphthalate, a nylon, a polyurethane elastomer, a polyolefin elastomer, a polyamide elastomer, and the like, or a blend of two or more resins selected therefrom. While the same thermoplastic resin film is used for the laminate both on the front and rear surfaces in the present embodiment, different thermoplastic resin films may be used on the front and rear surfaces. The thermal bonding of the laminate may be based on the thermoplasticity of the thermoplastic foam sheet and the thermoplastic resin film, or a thermoplastic adhesive printed or otherwise applied on the thermoplastic resin film.

A first diaphragm portion 21 of the loudspeaker diaphragm 2 is a generally rectangular area in the central portion of the rear surface of the loudspeaker diaphragm 2 that is defined by the two long sides of the elongated loudspeaker diaphragm 2 and two virtual lines X and X' extending in the minor-axis direction across the long sides. The distance between the virtual lines X and X', which is about 40 mm in the present embodiment, can be set to be larger than the diameter of the voice coil bobbin 4*a* and within about ½ of the length L1 in the major-axis direction of the loudspeaker diaphragm 2. Referring to FIG. 4B, the first diaphragm portion 21 includes a circular flat portion 23 in the central portion of the rear surface, to which one end of the generally cylindrical voice coil bobbin 4*a* is attached. The inside of the circular flat portion 23 is in a dome shape. The peripheral portion of the circular flat portion 23 has a generally cone shape with a rise such as to connect to a second diaphragm portion 22 to be described later. The first diaphragm portion 21, which contributes to the reproduction of the middle range and the high range, is thinner than the second diaphragm portion 22, and the average thickness t1 of the first diaphragm portion 21 is about 2 mm.

The second diaphragm portion 22 is an area at each end of the elongated loudspeaker diaphragm 2 that is defined by the two long sides of the elongated loudspeaker diaphragm 2, one short side thereof, and the virtual line X (or X'). The short side portion of the racetrack-shaped loudspeaker diaphragm 2 of the present embodiment includes a semi-circular portion defining the racetrack shape. The cross-sectional shape of the second diaphragm portion 22 in the minor-axis direction is in a generally W-letter shape as shown in FIG. 4C, and is substantially unvaried except for the semi-circular portions being the short sides. In the present embodiment, the average thickness t2 of the second diaphragm portion 22 is about 3 mm, being greater than the average thickness t1 of the first diaphragm portion 21.

The reinforcement ribs of the loudspeaker diaphragm 2 are each a protrusion that forms either a ridge or a trough as seen from the front side of the loudspeaker diaphragm 2. Specifically, in the present embodiment, a major-axis central rib 24 and two major-axis side ribs 25, formed at opposite ends in the minor-axis direction of the loudspeaker diaphragm 2, extend continuously through the first diaphragm portion 21 and the second diaphragm portions 22. In other words, the major-axis central rib 24 and the major-axis side ribs 25 extend in the major-axis direction, corresponding to the three upper points in the generally W-letter shape of the cross-sectional shape of the loudspeaker diaphragm 2, thereby improving the rigidity in the major-axis direction of the loudspeaker diaphragm 2. Minor-axis side ribs 26 are formed in an arc shape in conformity to the semi-circular shape of the second diaphragm portion 22 to connect the major-axis side ribs 25 together, thereby reinforcing the outer periphery of the racetrack-shaped loudspeaker diaphragm 2 and thus improving the rigidity. The ridge of the major-axis central rib 24 does not reach the opposite ends of the racetrack-shaped loudspeaker diaphragm 2 in the major-axis direction, and the major-axis central rib 24 is therefore not connected to the minor-axis side ribs 26. Nevertheless, the major-axis central rib 24 connects together the first diaphragm portion 21 and the second diaphragm portions 22, thus reinforcing the racetrack-shaped loudspeaker diaphragm 2 and improving the rigidity.

The edge 3 is in a racetrack shape whose opening measures about 195 mm×about 21 mm, with the radius of the semi-circular shape being about 10.5 mm. In the present embodiment, the edge 3 is obtained by pouring a flexible foam rubber material into a mold and then heating the material to allow foaming, thereby integrally forming not only the movable portion of the edge 3 but also a reinforcement 34 along the outer periphery to be fixed to the fixing portion of the frame 6. In the present embodiment, a thermally-bonding adhesive is applied on the outer periphery portion of the loudspeaker diaphragm 2 and is let dry, after which the loudspeaker diaphragm 2 and the edge 3 are heat-pressed together using an attachment die, thus obtaining a diaphragm product of which the reinforcement 34 is an integral part.

Specifically, the edge 3 includes free edge portions (including a first free edge portion 31 corresponding to the first diaphragm portion 21, and a second free edge portion 32 corresponding to the second diaphragm portion 22) and a fixed edge portion 33. The free edge portions 31 and 32 freely support the opposite ends of the loudspeaker diaphragm 2 in the minor-axis direction along the long sides of the racetrack shape extending in straight lines in the major-axis direction of the loudspeaker diaphragm 2. The fixed edge portion 33 fixedly supports the loudspeaker diaphragm 2 along the arc-shaped short sides of the racetrack shape. Referring to FIGS. 4B and 4C, the first free edge portion 31 and the second free edge portion 32 are each a free edge having a movable single-ridged roll of an inverted V-letter shape, and the thickness of the foam rubber is about 0.2 mm in these portions.

Referring to FIG. 4A, the fixed edge portion 33 is a fixed edge extending from the gasket-like reinforcement 34 and formed with a large thickness with no rolled movable portion. The outer periphery side of the fixed edge portion 33, connected to the reinforcement 34, is fixed to the fixing portion of the frame 6, and the inner periphery side thereof is fixed to the second diaphragm portion 22. Thus, the fixed edge portion 33 supports the opposite ends of the racetrack shape of the loudspeaker diaphragm 2 so as not to allow free vibrations thereof. In other words, the fixed edge portion 33 is obtained by filling up a portion thereof corresponding to the movable portion of the first free edge portion 31 and the second free edge portion 32 including the inverted V-letter-shaped portion with a foam rubber so as not to allow free vibrations, with the thickness of the foam rubber being about 2 mm to about 3.5 mm. As a result, the fixed edge portion 33 restricts the opposite ends of the loudspeaker diaphragm 2 in the major-axis direction. It is not necessary that the fixed edge portion 33 has a large thickness all along the shorter-side arc portion of the racetrack shape, and the shorter-side arc portion of the racetrack shape may be partly a fixed edge and partly a free edge.

Therefore, the electrodynamic loudspeaker 1 including the elongated loudspeaker diaphragm 2 and the edge 3 of the present embodiment is flexibly supported by the compliance of the free edge portion of the edge 3 in the minor-axis direction while being allowed to vibrate in bending vibration by the flexibility of the thermoplastic resin foam sheet of the loudspeaker diaphragm 2 in the major-axis direction. As a result, it is possible to realize a flat frequency response while suppressing dips which are likely to first appear in the low range, as will be described below. Moreover, as will also be described below, due to the rigidity of the reinforcement ribs, it is possible to improve the symmetry between the forward and backward amplitudes of the loudspeaker diaphragm, thereby realizing an electrodynamic loudspeaker having a desirable sound reproduction quality with little distortion. Since the average thickness t1 of the first diaphragm portion 21 is smaller than the average thickness t2 of the second diaphragm portion 22, it is possible to improve the efficiency of reproduction for the middle range and the high range, thus realizing an electrodynamic loudspeaker with a wide reproducing frequency range.

Figure 5A:
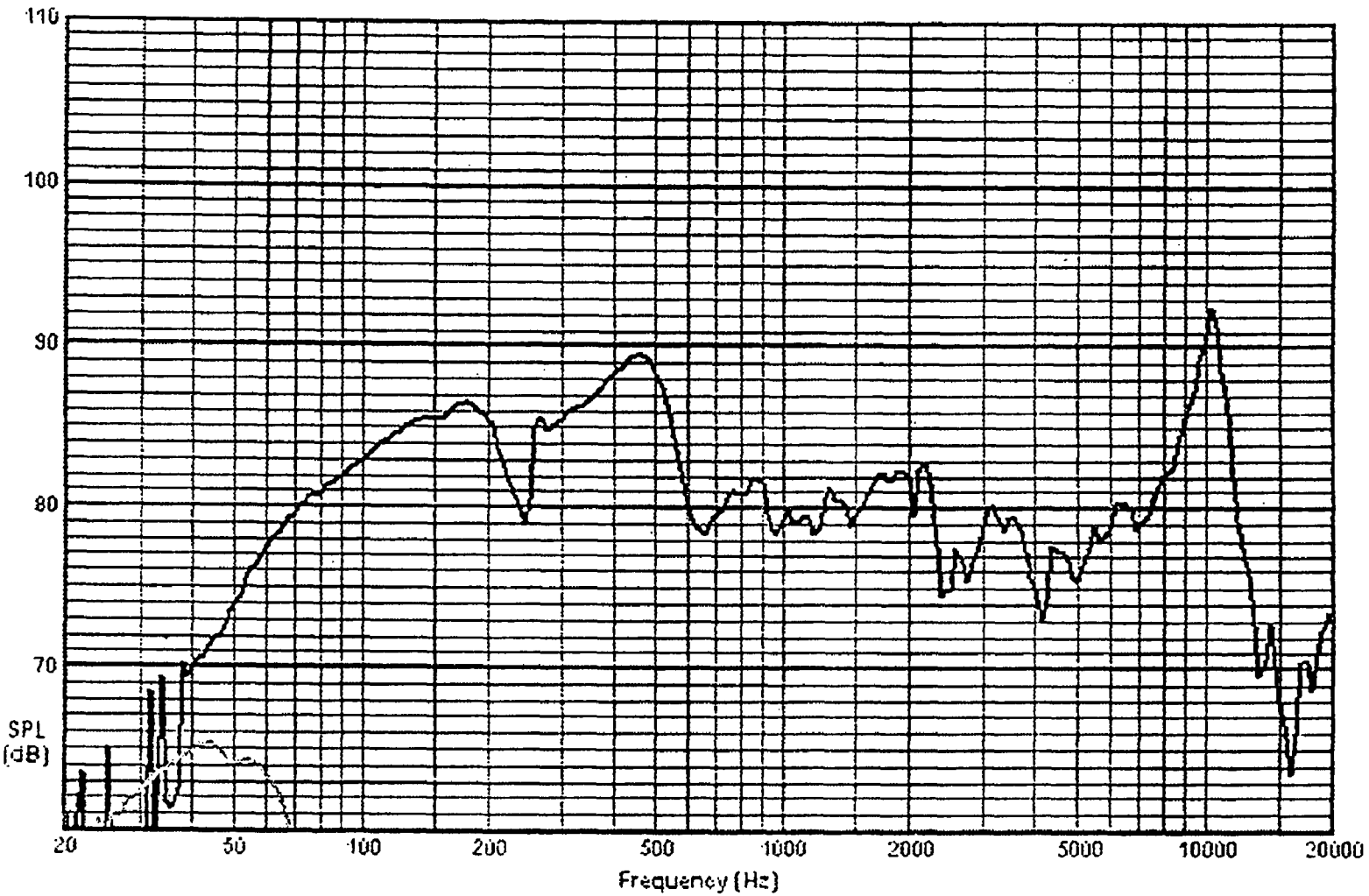
FIGS. 5A and 5B are graphs each illustrating an operation of the electrodynamic loudspeaker 1.
Figure 5B:
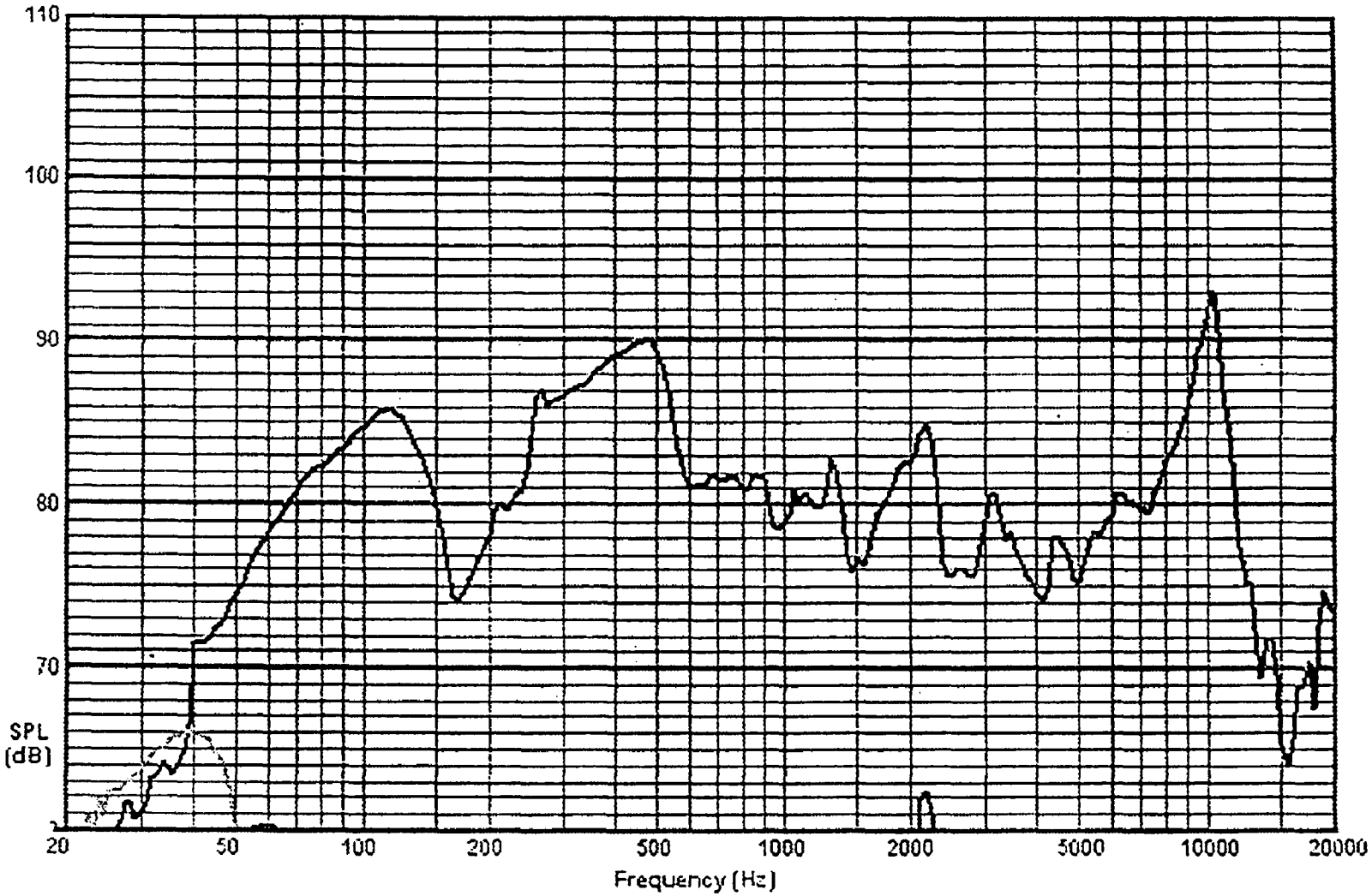
Figure 6B:
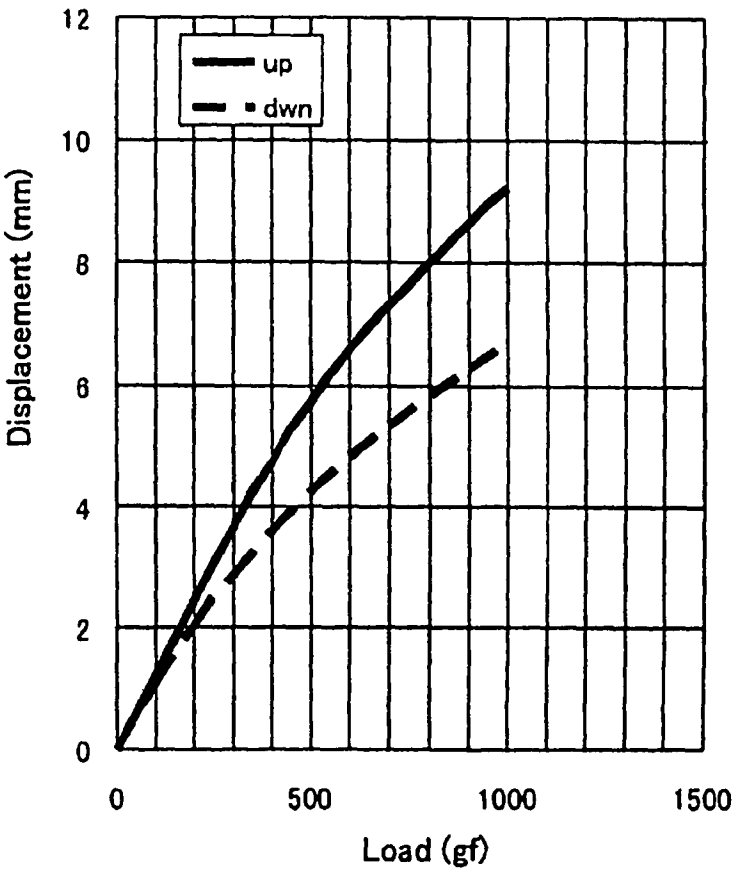
FIGS. 6A and 6B are graphs each illustrating the amount of displacement in the forward and backward amplitudes of the electrodynamic loudspeaker 1 when a driving force is applied.
Figure 6A:
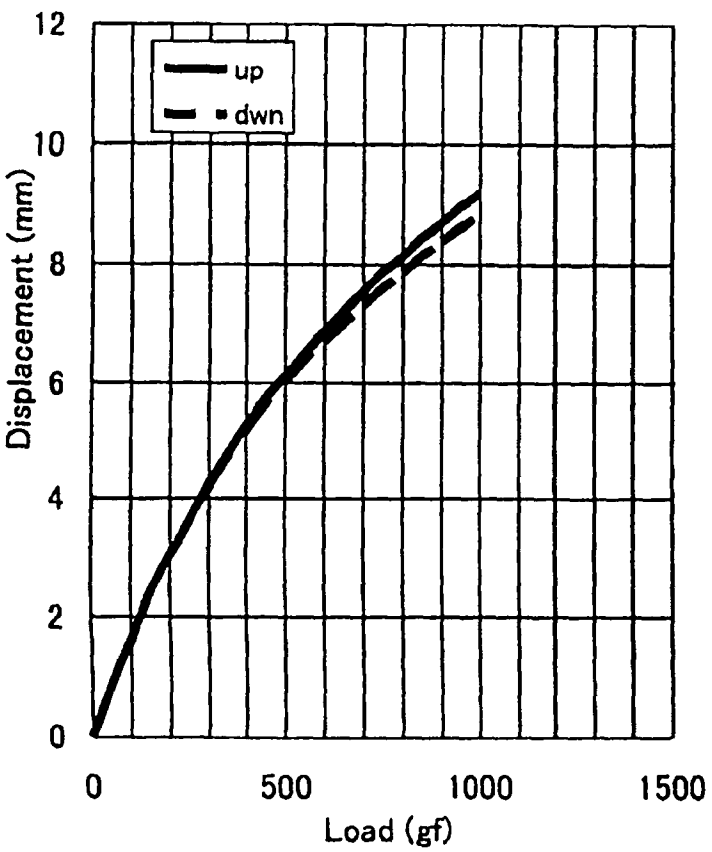

FIGS. 5A and 5B are graphs each illustrating an operation of the electrodynamic loudspeaker 1 including the elongated loudspeaker diaphragm 2 and the edge 3 of the present embodiment, wherein FIG. 5A is a graph illustrating the frequency response in one embodiment of the present invention, and FIG. 5B is a graph illustrating the frequency response of a conventional electrodynamic loudspeaker as a reference example. FIGS. 6A and 6B are graphs each illustrating the amounts of forward and backward displacements for a driving force applied to the voice coil 4 including the loudspeaker diaphragm 2 in the electrodynamic loudspeaker 1, wherein the absolute values are used for both the forward and backward directions so that the bottom half of the curve is folded back up, whereby the forward displacement curve and the backward displacement curve lying closer to each other means a better forward/backward symmetry. The electrodynamic loudspeaker of the reference example uses an elongated loudspeaker diaphragm (not shown) formed by using substantially the same materials and components, with the difference from the embodiment of the present invention being that the loudspeaker diaphragm is in a boat shape without the major-axis central rib 24 and that the reference example includes a free edge portion for freely supporting the loudspeaker diaphragm along the short side of the racetrack shape being in an arc shape.

Referring to FIGS. 5A and 5B, the electrodynamic loudspeaker 1 including the elongated loudspeaker diaphragm 2 and the edge 3 of the present embodiment no longer has a wide dip extending over a range of about 120 Hz to about 240 Hz and a dip at about 1.5 kHz, which are seen in the reference example, thus realizing a relatively flat frequency response. Referring to FIGS. 6A and 6B, the electrodynamic loudspeaker 1 of the present embodiment improves the symmetry between the forward and backward amplitudes from that of the reference example. Thus, it is possible to reduce problems such as the even order distortion, the flapping noise, and the like, which occur due to the forward/backward asymmetry. While the reference example using a boat-shaped diaphragm without the major-axis central rib 24 exhibits a significant forward/backward asymmetry due to the insufficient rigidity in the major-axis direction, the present embodiment has an improved forward/backward displacement symmetry and is capable of a better sound reproduction.

In the present embodiment, the weight of the vibrating system of the diaphragm product including the elongated loudspeaker diaphragm 2 and the edge 3 (including the reinforcement 34) is about 1.56 g (the diaphragm body: 1.18 g, the diaphragm portion adhesive: 0.2 g, and the edge movable portion: 0.55 g, wherein ⅓ of the edge movable portion is taken into the mass of the vibrating system). The amount of time required for producing the diaphragm product is 85 seconds in total, including 10 seconds for molding the loudspeaker diaphragm 2, 5 seconds for cutting the loudspeaker diaphragm 2, 30 seconds for molding the edge 3, 15 seconds for cutting the edge 3, 10 seconds for the adhesive application, and 15 seconds for the attachment.

Embodiment 2

A loudspeaker diaphragm 2A of the present embodiment (not shown) will now be described. The loudspeaker diaphragm 2A is obtained by simultaneously and integrally molding a body portion of the loudspeaker diaphragm 2A, an edge 3A and a reinforcement 34A by using a material obtained by laminating a thermoplastic resin film on the front and rear surfaces of a thermoplastic foam sheet. In the loudspeaker diaphragm 2A, a polyurethane elastomer film is thermally bonded on the front and rear surfaces of an extruded polystyrene paper, which is subjected to a plug-assist vacuum molding as described above to thereby obtain a diaphragm body having the same shape as that of the loudspeaker diaphragm 2 of Embodiment 1 above. The present embodiment differs from Embodiment 1 in that the edge 3A is integrally formed from the polyurethane elastomer film which is extended from the front and rear surfaces of the loudspeaker diaphragm 2A so as to form a free edge at each end in the minor-axis direction and a fixed edge at each end in the major-axis direction. Moreover, the reinforcement 34A, which supports the outer periphery of the edge 3A, is integrally formed by a polystyrene paper both sides of which are laminated with a polyurethane elastomer film, as is the body portion of the loudspeaker diaphragm 2A.

Specifically, the diaphragm body portion of the loudspeaker diaphragm 2A differs from the loudspeaker diaphragm 2 of the preceding embodiment in that the laminated thermoplastic resin film is a polyurethane elastomer film (thickness: about 50 μm). The racetrack-shaped loudspeaker diaphragm 2 has a length L1 in the major-axis direction of about 198 mm and a length L2 in the minor-axis direction of about 23.4 mm. The thickness of the loudspeaker diaphragm 2A varies in the range from about 0.3 mm to about 3 mm, and the loudspeaker diaphragm 2A has a cross-sectional shape and reinforcement ribs as described above with respect to the loudspeaker diaphragm 2. Therefore, like elements to those of the electrodynamic loudspeaker 1 of Embodiment 1 above are denoted by like reference numerals and will not be further described below.

The edge 3A is in a racetrack shape whose opening measures about 195 mm×about 21 mm, with the radius of the semi-circular shape being about 10.5 mm. In the present embodiment, free edge portions of the edge 3A (including a first free edge portion 31A corresponding to the first diaphragm portion 21 and a second free edge portion 32A corresponding to the second diaphragm portion 22) are formed integrally with a polystyrene foam sheet formed to be very thin on a polyurethane elastomer film which is extended from the front and rear surfaces of the loudspeaker diaphragm 2A, resulting in a thickness of about 0.3 mm. As with the loudspeaker diaphragm 2, the thickness of a fixed edge portion 33A of the edge 3A gradually increases from about 0.3 mm to 2.5 mm so as to be connected continuously to the reinforcement 34A. The reinforcement 34A is formed in a shape with a large thickness, thus providing a gasket having a good rigidity, making use of the thickness of the polystyrene foam sheet.

In the present embodiment, the weight of the diaphragm product including the elongated loudspeaker diaphragm 2A and the edge 3A (including the reinforcement 34) is about 1.51 g. With ⅓ of the edge movable portion being taken into the mass of the vibrating system, the weight of the vibrating system is about 1.29 g. As compared with the edge 3 of the preceding embodiment, this is about a 17% reduction in the weight of the vibrating system. Thus, when the loudspeaker diaphragm is used in an electrodynamic loudspeaker, it is possible to improve the sound pressure level.

Therefore, even though the edge 3A of the present embodiment is formed integrally with the loudspeaker diaphragm 2A, the cross-sectional shape thereof can be made substantially the same as that with the foam rubber edge of the preceding embodiment, wherein the electrodynamic loudspeaker is flexibly supported by the compliance of the free edge portion of the edge 3A in the minor-axis direction while being allowed to vibrate in bending vibration by the flexibility of the polystyrene paper of the loudspeaker diaphragm 2A in the major-axis direction. As a result, an electrodynamic loudspeaker employing a loudspeaker diaphragm of the present embodiment can realize a flat frequency response while suppressing dips which are likely to first appear in the low range. Moreover, no variations occur in the amount of adhesive to be applied for the attachment between the loudspeaker diaphragm 2A and the edge 3A and the attachment between the edge 3A and the reinforcement 34A, and no variations occur in the alignment in the attachment step. Moreover, no variations occur in the amount of adhesive to be applied for the sealing of the attachment portion. As a result, there is obtained a stable quality with no variations in the characteristics of the electrodynamic loudspeaker.

Moreover, in the present embodiment, the diaphragm product, being an integral part including the loudspeaker diaphragm, the edge and the reinforcement, can be obtained in a single step, thus eliminating the material cost for the edge and the reinforcement and the process cost for molding. This also eliminates the material cost for the adhesive for attaching the loudspeaker diaphragm with the edge and for attaching the edge with the reinforcement paper, the process cost for the adhesive application and the attachment, the material cost for the adhesive for the sealing of the attachment portion, and the process cost for the adhesive application. As compared with a total of 85 seconds, which is required for the production of the diaphragm product in a case where the loudspeaker diaphragm 2 and the edge 3 are separate components, the production of the diaphragm product in the present embodiment requires only 15 seconds in total, including 10 seconds for molding the diaphragm and 5 seconds for cutting the diaphragm. Thus, in the present embodiment, it is possible to obtain the diaphragm product in about ⅙ the amount of time. Thus, as compared with the electrodynamic loudspeaker of the preceding embodiment, it is possible to reduce the number of components, the total weight, and the cost.

Embodiment 3

An electrodynamic loudspeaker 1B including a loudspeaker diaphragm 2B (not shown) and an edge 3B (not shown) of the present embodiment will now be described. The loudspeaker diaphragm 2B is the same as the loudspeaker diaphragm 2A of Embodiment 2 above in that a polyurethane elastomer film is thermally bonded on the front and rear surfaces of an extruded polystyrene paper, and will not be further described below. Moreover, the dimensions and the shape of the edge 3B are the same as those of the preceding embodiment. However, the material and the arrangement of the edge 3B are different from those of the preceding embodiment.

With the edge 3B of the present embodiment, different materials are used, between a first diaphragm portion 21B and a second diaphragm portion 22B, for the free edge portions for freely supporting the opposite ends of the loudspeaker diaphragm 2B in the minor-axis direction along the long sides of the racetrack shape extending in straight lines in the major-axis direction of the loudspeaker diaphragm 2B. Specifically, a first free edge portion 31B corresponding to the first diaphragm portion 21B to which the voice coil 4 is attached is formed by using a softer material with the stiffness k1 being smaller than the stiffness k2 of a second free edge portion 32B corresponding to the second diaphragm portion 22B.

Specifically, the first free edge portion 31B for freely supporting the end of the first diaphragm portion 21B in the minor-axis direction is a light-weighted, soft edge obtained by attaching together two polyurethane elastomer films with an adhesive, whereas the second free edge portion 32B for freely supporting the end of the second diaphragm portion 22B in the minor-axis direction is an edge obtained by sandwiching an edge of a urethane foam having a thickness of about 0.3 mm between the above two polyurethane elastomer films. Thus, the latter edge is heavier and harder than the first free edge portion 31B. For example, in the present embodiment, the stiffness k1 of the first free edge portion 31B is about 250 N/m, whereas the stiffness k2 of the second free edge portion 32B is about 400 N/m.

Figure 7:
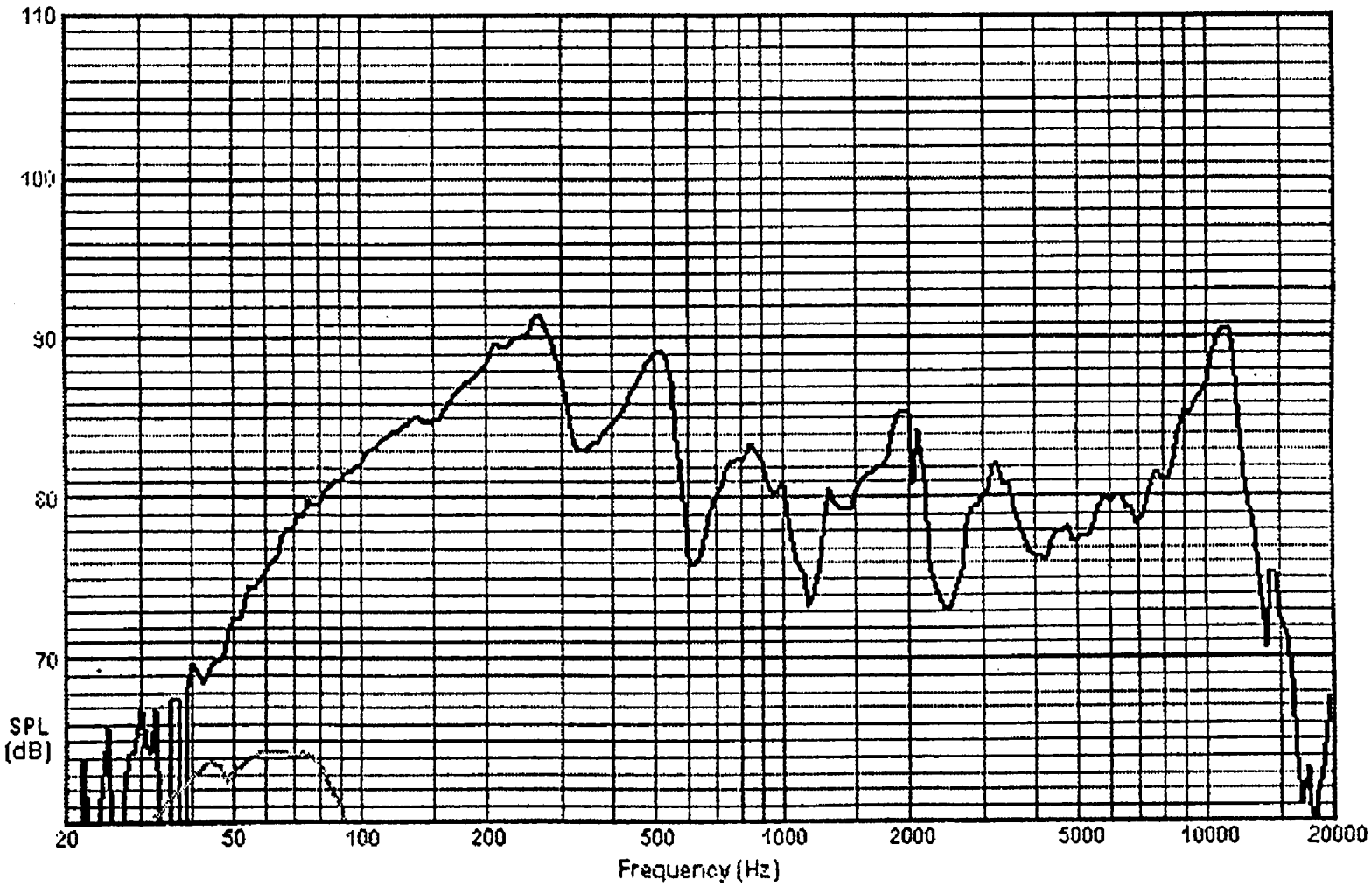
FIG. 7 is a graph illustrating a frequency response of an electrodynamic loudspeaker 1B.

FIG. 7 is a graph illustrating a frequency response of the electrodynamic loudspeaker 1B including the elongated loudspeaker diaphragm 2B and the edge 3B of the present embodiment. As in the preceding embodiment, the average thickness t1 of the first diaphragm portion 21B of the loudspeaker diaphragm 2B is smaller than the average thickness t2 of the second diaphragm portion 22B, whereby it is possible to improve the efficiency of reproduction for the middle range and the high range, thus realizing an electrodynamic loudspeaker with a wide reproducing frequency range. In the electrodynamic loudspeaker 1B of the present embodiment, the first free edge portion 31B for freely supporting the opposite ends of the first diaphragm portion 21B in the minor-axis direction is a flexible, light-weighted edge, whereby it is possible to further improve the efficiency of reproduction for the middle range and the high range.

The present invention is not limited to cases where the material of the first free edge portion 31B is different from the material of the second free edge portion 32B. If the same material is used, the thickness of the roll of the edge may be varied between the two free edge portions, thereby adjusting the stiffness relationship therebetween. Where the edge 3B of the present embodiment is formed by two-color molding using two different rubber or resin materials, it is possible to adjust the stiffnesses of the first free edge portion 31B and the second free edge portion 32B by determining the material arrangement based on the moduli of elasticity of the materials and optimizing the shape of the edge.

Embodiment 4

Figure 8:
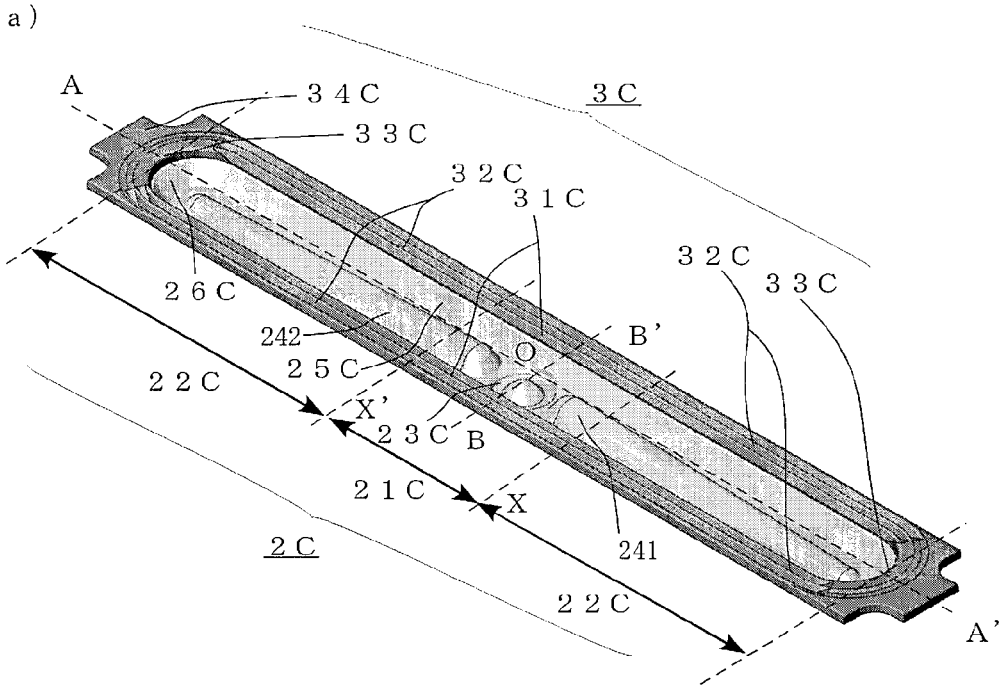
FIGS. 8A and 8B illustrate a loudspeaker diaphragm 2C and an edge 3C.
Figure 8:
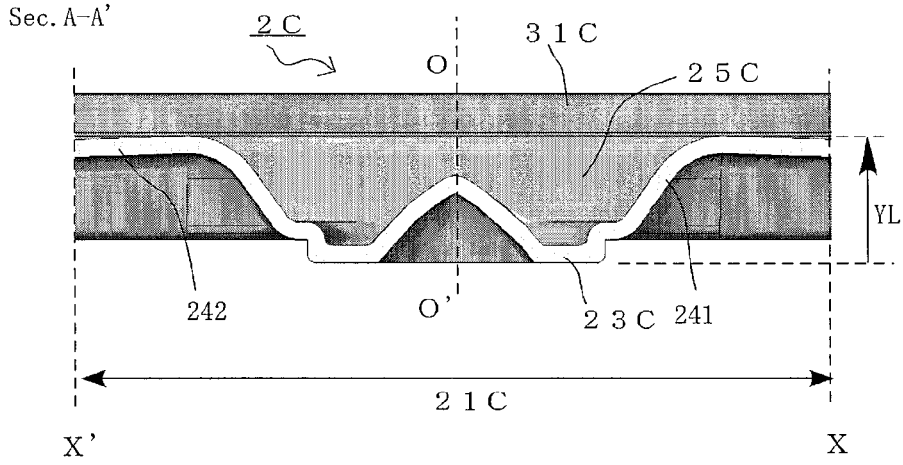

FIGS. 8A and 8B illustrate a loudspeaker diaphragm 2C and an edge 3C according to another embodiment of the present invention. FIG. 8A is a perspective view of the loudspeaker diaphragm 2C and the edge 3C as viewed in an inclined direction from the front side, and FIG. 8B is an enlarged cross-sectional view of the loudspeaker diaphragm 2C and the edge 3C taken along line A-A'. As will be explained later, some elements of the loudspeaker diaphragm 2C and the edge 3C, the cross section thereof, etc., may not be shown in the figures. The direction of line A-A' is the major-axis direction, and the direction of line B-B' is the minor-axis direction.

The loudspeaker diaphragm 2C of the present embodiment is formed to have a reinforcement rib by subjecting an extruded polypropylene (PP) sheet having a substantially uniform thickness to a plug-assist vacuum molding. Specifically, the loudspeaker diaphragm 2C is formed by a plug-assist vacuum molding as described above using a 10-times-expansion extruded polypropylene foam sheet (thickness: about 1.1 mm) mixed with 10% of an acrylic. The racetrack-shaped loudspeaker diaphragm 2C has a length L1 in the major-axis direction of about 262.0 mm and a length L2 in the minor-axis direction of about 25.5 mm. A first diaphragm portion 21C and a second diaphragm portion 22C of the loudspeaker diaphragm 2C are defined as in the preceding embodiment.

Specifically, the first diaphragm portion 21C is a generally rectangular area in the central portion of the loudspeaker diaphragm 2C that is defined by the two long sides of the elongated loudspeaker diaphragm 2 and the two virtual lines X and X' extending in the minor-axis direction across these long sides. The distance between the virtual lines X and X', which is about 34.0 mm in the present embodiment, can be set to be larger than the diameter of the voice coil bobbin 4*a* and within about ½ of the length L1 in the major-axis direction of the loudspeaker diaphragm 2C. As shown in the enlarged cross-sectional view of FIG. 8B, the first diaphragm portion 21C, which contributes to the reproduction of the middle range and the high range, includes a circular flat portion 23C in the central portion of the rear surface, to which one end of the voice coil bobbin 4*a* having a generally cylindrical shape (not shown) is attached. The inside of the circular flat portion 23C is in a dome shape. The peripheral portion of the circular flat portion 23C has a generally cone shape with a rise such as to connect to the second diaphragm portion 22C to be described later.

The second diaphragm portion 22C is an area at each end of the elongated loudspeaker diaphragm 2C that is defined by the two long sides of the elongated loudspeaker diaphragm 2C, one short side thereof, and the virtual line X (or X'). The short side portion of the racetrack-shaped loudspeaker diaphragm 2C of the present embodiment includes a semi-circular portion defining the racetrack shape. In the present embodiment, the average thickness of the second diaphragm portion 22C is about 1.1 mm, being the same as that of the first diaphragm portion 21C, and the second diaphragm portion 22C is formed to have a substantially uniform thickness.

Since the loudspeaker diaphragm 2C of the present embodiment is formed so that the thickness thereof is uniform across the entirety thereof, it is possible to ensure the level of rigidity required in the major-axis direction by optimizing the arrangement and the shape of the reinforcement ribs. Specifically, the loudspeaker diaphragm 2C includes reinforcement ribs extending in the major-axis direction and the minor-axis direction and the cross-sectional shape thereof in the minor-axis direction is a generally W-letter shape. In the present embodiment, the major-axis central rib 24, among other reinforcement ribs, is divided into two separate ribs, including a first major-axis central rib 241 and a second major-axis central rib 242, which are arranged with the junction to the voice coil bobbin 4*a* (not shown) being interposed therebetween. At the center of the circular flat portion 23C, which forms the junction, there is formed a dome-shaped portion protruding upward. Two major-axis side ribs 25C, formed at the opposite ends of the loudspeaker diaphragm 2C in the minor-axis direction, extend continuously through the first diaphragm portion 21C and the second diaphragm portions 22C.

The first major-axis central rib 241 and the second major-axis central rib 242, arranged in symmetry with respect to the central point O, extend continuously through the first diaphragm portion 21C and the second diaphragm portions 22C as shown in FIGS. 8A and 8B. The height YL of the first major-axis central rib 241 and the second major-axis central rib 242 is largest in the first diaphragm portion 21 and gradually decreases through the second diaphragm portion 22 toward either end in the major-axis direction. Moreover, the width of the first major-axis central rib 241 and the second major-axis central rib 242 as viewed from the front side of the loudspeaker diaphragm 2C is largest in the first diaphragm portion 21C and gradually decreases through the second diaphragm portion 22C toward either end in the major-axis direction. In the first diaphragm portion 21C, the two major-axis side ribs 25C are formed at opposite ends of the circular flat portion 23C in the minor-axis direction, with a dome-shaped portion being formed inside the circular flat portion 23C. Therefore, even though the first major-axis central rib 241 and the second major-axis central rib 242 are separated from each other, it is possible to improve the rigidity of the loudspeaker diaphragm 2 in the major-axis direction and to realize a relatively flat frequency response as will be described below.

Although the shape of a reinforcement 34C along the outer periphery is different from that described in Embodiment 1 above, the edge 3C is substantially the same as that of Embodiment 1, and is in a racetrack shape whose opening measures about 259.5 mm×about 22.0 mm, with the radius of the semi-circular shape being about 11.0 mm. Specifically, the edge 3C includes free edge portions (including a first free edge portion 31C and a second free edge portion 32C), and a fixed edge portion 33C. The free edge portions freely support the opposite ends of the loudspeaker diaphragm 2C in the minor-axis direction along the long sides of the racetrack shape extending in straight lines in the major-axis direction of the loudspeaker diaphragm 2C. The fixed edge portion 33C fixedly supports the loudspeaker diaphragm 2C along the arc-shaped short sides of the racetrack shape. The edge 3C is obtained by pouring a flexible foam rubber material into a mold and then heating the material to allow foaming. In the present embodiment, a thermally-bonding adhesive is applied on the outer periphery portion of the loudspeaker diaphragm 2C and is let dry, after which the loudspeaker diaphragm 2C and the edge 3C are heat-pressed together using an attachment die, thus obtaining a diaphragm product of which the reinforcement 34C is an integral part.

Therefore, an electrodynamic loudspeaker 1C (not shown) including the elongated loudspeaker diaphragm 2C and the edge 3C of the present embodiment is flexibly supported by the compliance of the free edge portion of the edge 3C in the minor-axis direction while being allowed to vibrate in bending vibration by the flexibility of the thermoplastic resin foam sheet of the loudspeaker diaphragm 2C in the major-axis direction. As a result, it is possible to improve the symmetry between the forward and backward amplitudes of the loudspeaker diaphragm 2C due to the rigidity of the first major-axis central rib 241 and the second major-axis central rib 242, as will be described below, thereby realizing an electrodynamic loudspeaker having a desirable sound reproduction quality with little distortion.

Figure 9:
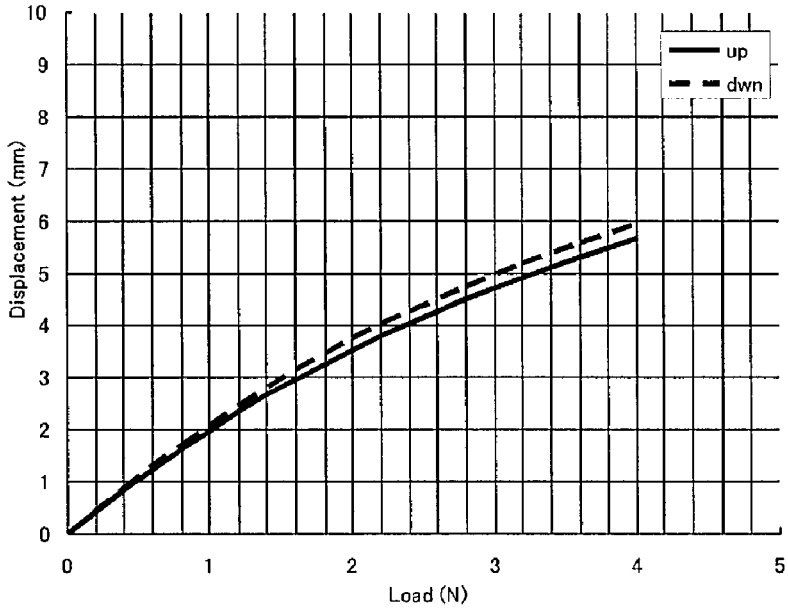
FIG. 9 is a graph illustrating the amounts of forward and backward displacements of an electrodynamic loudspeaker 1C when a driving force is applied.
Figure 10:
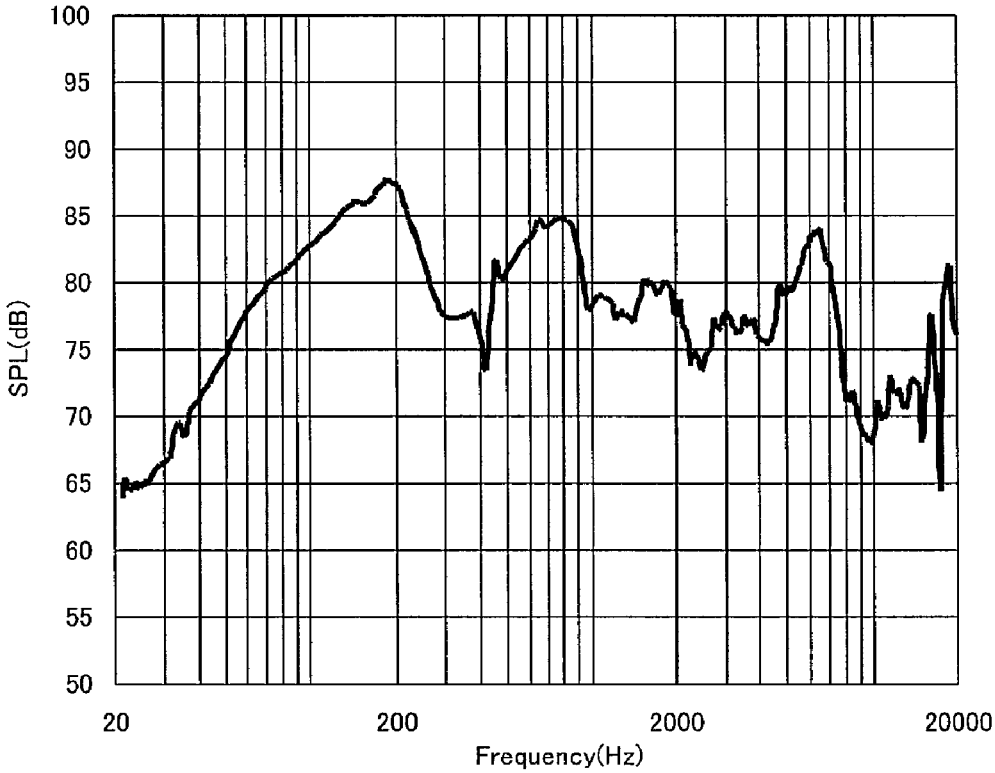
FIG. 10 is a graph illustrating a frequency response of the electrodynamic loudspeaker 1C.

FIG. 10 is a graph illustrating a frequency response of the electrodynamic loudspeaker 1C including the elongated loudspeaker diaphragm 2C and the edge 3C of the present embodiment. FIG. 9 is a graph illustrating the amounts of forward and backward displacements for a driving force applied to the voice coil 4 including the loudspeaker diaphragm 2C in the electrodynamic loudspeaker 1C of the present embodiment, wherein the absolute values are used for both the forward and backward directions so that the bottom half of the curve is folded back up, whereby the forward displacement curve and the backward displacement curve lying close to each other means a good forward/backward symmetry.

Referring to FIG. 9, the electrodynamic loudspeaker 1C of the present embodiment improves the symmetry between the forward and backward amplitudes from that of the reference example in the preceding embodiment. Thus, it is possible to reduce problems such as the even order distortion, the flapping noise, and the like, which occur due to the forward/backward asymmetry. The electrodynamic loudspeaker 1C including the elongated loudspeaker diaphragm 2C and the edge 3C of the present embodiment is capable of realizing a relatively flat frequency response, as with other embodiments, as shown in FIG. 10, with an improved forward/backward displacement symmetry, and is capable of a better sound reproduction.

Each of the loudspeaker diaphragms of the present invention may employ any other suitable elongated shape or may be of any other suitable dimensions accommodating the voice coil diameter. The electrodynamic loudspeaker using such a loudspeaker diaphragm of the present invention is not limited to a racetrack-shaped loudspeaker, but may be any electrodynamic loudspeaker of an elongated shape with a large ratio between the major-axis dimension and the minor-axis dimension, such as an elliptical shape, an elongated circular shape and a rectangular shape.

The loudspeaker magnetic circuit of the present embodiment may be a magnetic circuit of a different dimension accommodating other voice coil diameters. The electrodynamic loudspeaker may employ a magnetic circuit of any type, including an inner-magnet type, an outer-magnet type and a repulsive type, as long as the width of the magnetic circuit is smaller than that of the elongated frame and the generally cylindrical voice coil can be attached to the central portion of the rear surface of the loudspeaker diaphragm.

The electrodynamic loudspeaker of the present invention is applicable not only to a loudspeaker installed in a visual/acoustic device such as a display device, but also to an amusement machine having a cabinet for accommodating a loudspeaker for reproducing sound, such as a game machine and a slot machine. An electrodynamic loudspeaker including a loudspeaker magnetic circuit of the present invention has a small overall width and can therefore realize a loudspeaker system reproducing sound in a small, thin cabinet, and is particularly suitable as a vehicle loudspeaker, which needs to be installed in a limited space.

What is claimed is:

1. A loudspeaker diaphragm, comprising a diaphragm body of an elongated shape defining a major-axis direction and a minor-axis direction, and an edge for supporting an outer periphery of the diaphragm body, wherein:

the diaphragm body includes a first diaphragm portion in a central portion of a rear surface thereof, the first diaphragm portion including a junction to a voice coil bobbin, a second diaphragm portion extending on each side of the first diaphragm portion in the major-axis direction and is void of a junction to the voice coil bobbin, and a reinforcement rib extending continuously through the first diaphragm portion and the second diaphragm portions; and the edge includes a free edge portion for freely supporting opposite ends in the minor-axis direction of the first diaphragm portion and the second diaphragm portion, and a fixed edge portion being thicker than the free edge portion for fixedly supporting a distal end of each second diaphragm portion in the major-axis direction.

2. The loudspeaker diaphragm according to claim 1, wherein the first diaphragm portion of the diaphragm body has an area larger than a projected area of the voice coil bobbin, and an average thickness of the first diaphragm portion is smaller than that of the second diaphragm portion.

3. The loudspeaker diaphragm according to claim 1, wherein:

the reinforcement rib includes major-axis side ribs formed at opposite ends of the diaphragm body in the minor-axis direction, a major-axis central rib formed in a central portion of the diaphragm body in the minor-axis direction, and a minor-axis side rib formed at a distal end of each second diaphragm portion in the major-axis direction; and the minor-axis side ribs connect together the major-axis side ribs and are not connected to the major-axis central rib.

4. An electrodynamic loudspeaker, comprising the loudspeaker diaphragm according to claim 3, a frame to which an outer periphery of the edge is fixed, a magnetic circuit fixed to the frame and having a magnetic gap, a voice coil wound around the voice coil bobbin, and a damper for disposing the voice coil in the magnetic gap.

5. The loudspeaker diaphragm according to claim 3, wherein:

the major-axis central rib of the reinforcement rib is divided into two separate ribs, including a first major-axis central rib and a second major-axis central rib, which are arranged with the junction to the voice coil bobbin being interposed therebetween; and a height of the first major-axis central rib and the second major-axis central rib is largest in the first diaphragm portion and gradually decreases through the second diaphragm portion toward either end in the major-axis direction.

6. An electrodynamic loudspeaker, comprising the loudspeaker diaphragm according to claim 5, a frame to which an outer periphery of the edge is fixed, a magnetic circuit fixed to the frame and having a magnetic gap, a voice coil wound around the voice coil bobbin, and a damper for disposing the voice coil in the magnetic gap.

7. The loudspeaker diaphragm according to claim 1, wherein the diaphragm body includes an extruded thermoplastic resin foam sheet whose surface is laminated with a thermoplastic resin film, and wherein the diaphragm body and the edge, which is obtained by integrally forming the free edge portion and the fixed edge portion, are bonded together by an adhesive.

8. The loudspeaker diaphragm according to claim 1, wherein the diaphragm body includes an extruded thermoplastic resin foam sheet whose front and rear surfaces are laminated with a thermoplastic resin film, and the edge includes the thermoplastic resin film extended from the front and rear surfaces of the diaphragm body, and wherein the diaphragm body and the edge are integrally formed with a reinforcement, the reinforcement being a thermoplastic resin foam sheet whose front and rear surfaces are laminated with the thermoplastic resin film for supporting an outer periphery of the edge.

9. The loudspeaker diaphragm according to claim 1, wherein:

the free edge portion of the edge includes a first free edge portion for freely supporting opposite ends of the first diaphragm portion in the minor-axis direction, and a second free edge portion for freely supporting opposite ends of the second diaphragm portion in the minor-axis direction; and a stiffness k1 of the first free edge portion is smaller than a stiffness k2 of the second free edge portion.

10. An electrodynamic loudspeaker, comprising the loudspeaker diaphragm according to claim 1, a frame to which an outer periphery of the edge is fixed, a magnetic circuit fixed to the frame and having a magnetic gap, a voice coil wound around the voice coil bobbin, and a damper for disposing the voice coil in the magnetic gap.

* * * * *